US007384163B2

(12) United States Patent
Yang

(10) Patent No.: US 7,384,163 B2
(45) Date of Patent: Jun. 10, 2008

(54) ROTATION KNOB TYPE LIGHT-REGULATING LAMP SOCKET

(75) Inventor: Wen-Ho Yang, Taipei County (TW)

(73) Assignee: Sun-Lite Sockets Industry Inc., Taoyuan (TW)

( * ) Notice: Subject to any disclaimer, the term of this patent is extended or adjusted under 35 U.S.C. 154(b) by 127 days.

(21) Appl. No.: 11/439,105

(22) Filed: May 23, 2006

(65) Prior Publication Data

US 2007/0275600 A1 Nov. 29, 2007

(51) Int. Cl.

| | |
|---|---|
| ***F21V 33/00*** | (2006.01) |
| ***F21V 17/00*** | (2006.01) |
| ***H01R 33/00*** | (2006.01) |
| ***H01R 33/955*** | (2006.01) |
| ***H01R 4/26*** | (2006.01) |
| ***H01C 10/00*** | (2006.01) |
| ***H05B 37/02*** | (2006.01) |

(52) U.S. Cl. ..... 362/95; 362/448; 362/650; 362/646; 200/51.14; 439/419; 338/70; 315/291; 315/300

(58) Field of Classification Search ..... 362/95, 362/448, 634, 646, 650; 200/51.14; 338/70; 315/291, 300

See application file for complete search history.

(56) References Cited

U.S. PATENT DOCUMENTS

| | | | | |
|---|---|---|---|---|
| 2,449,029 | A * | 9/1948 | Wean et al. | 336/92 |
| 3,372,302 | A * | 3/1968 | Fasola | 315/272 |
| 3,517,259 | A * | 6/1970 | Dotto | 315/200 R |
| 4,516,054 | A * | 5/1985 | Shikama et al. | 315/71 |
| 5,645,446 | A * | 7/1997 | Getselis et al. | 439/419 |
| 6,880,964 | B1 | 4/2005 | Yang | 362/802 |

* cited by examiner

*Primary Examiner*—Jong-Suk (James) Lee
*Assistant Examiner*—David J Makiya
(74) *Attorney, Agent, or Firm*—Alan Kamrath; Kamrath & Associates PA

(57) ABSTRACT

A lamp socket includes a first shell, a second shell combined with the first shell, a separation plate rested on a bottom of the first shell and the second shell, a base secured to the separation plate, an electronic unit mounted in the first shell and electrically connected to the base to supply an electric current to the base, a light-regulating unit mounted in the second shell and electrically connected to the electronic unit to regulate the electric current from the electronic unit to the base. Thus, the electronic unit is used to provide a current to light the electric bulb, and the light-regulating unit is used to regulate the current value of the electric bulb, so that the lamp socket has a stageless light-regulating function.

19 Claims, 11 Drawing Sheets

ROTATION KNOB TYPE LIGHT-REGULATING LAMP SOCKET

BACKGROUND OF THE INVENTION

1. Field of the Invention

The present invention relates to a lamp socket and, more particularly, to a rotation knob type light-regulating lamp socket.

2. Description of the Related Art

A conventional rotation knob type lamp socket is connected between a power supply and an electric bulb so that the current from the power supply is delivered through the lamp socket to the electric bulb so as to light the electric bulb. However, the conventional rotation knob type lamp socket does not have a stageless light-regulating function.

The closest prior art reference(s) of which the applicant is aware was disclosed in his U.S. Pat. No. 6,880,964, entitled "CHAIN-CONTROLLED LAMP STAND WITH MULTI-STAGE LIGHT MODULATION".

BRIEF SUMMARY OF THE INVENTION

The primary objective of the present invention is to provide a rotation knob type light-regulating lamp socket.

Another objective of the present invention is to provide a lamp socket having a stageless light-regulating function.

A further objective of the present invention is to provide a lamp socket, wherein the electronic unit is used to provide a current to light the electric bulb, and the light-regulating unit is used to regulate the current value of the electric bulb, so that the lamp socket has a light-regulating function.

A further objective of the present invention is to provide a lamp socket, wherein the current value of the electric bulb is regulated successively by rotation of the rotation member, so that the lamp socket has a stageless light-regulating function.

A further objective of the present invention is to provide a lamp socket, wherein the heat dissipation holes and the radiating plate are used to provide a heat radiating effect to the electronic parts of the electronic unit, so that the electronic parts are operated smoothly and stably.

A further objective of the present invention is to provide a lamp socket, wherein the heat sensitive resistor of the electronic unit has a resistance that is increased with rise of the temperature to reduce the lightness of the electric bulb and is decreased with drop of the temperature to increase the lightness of the electric bulb so as to control the temperature and to regulate the lightness of the electric bulb automatically.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
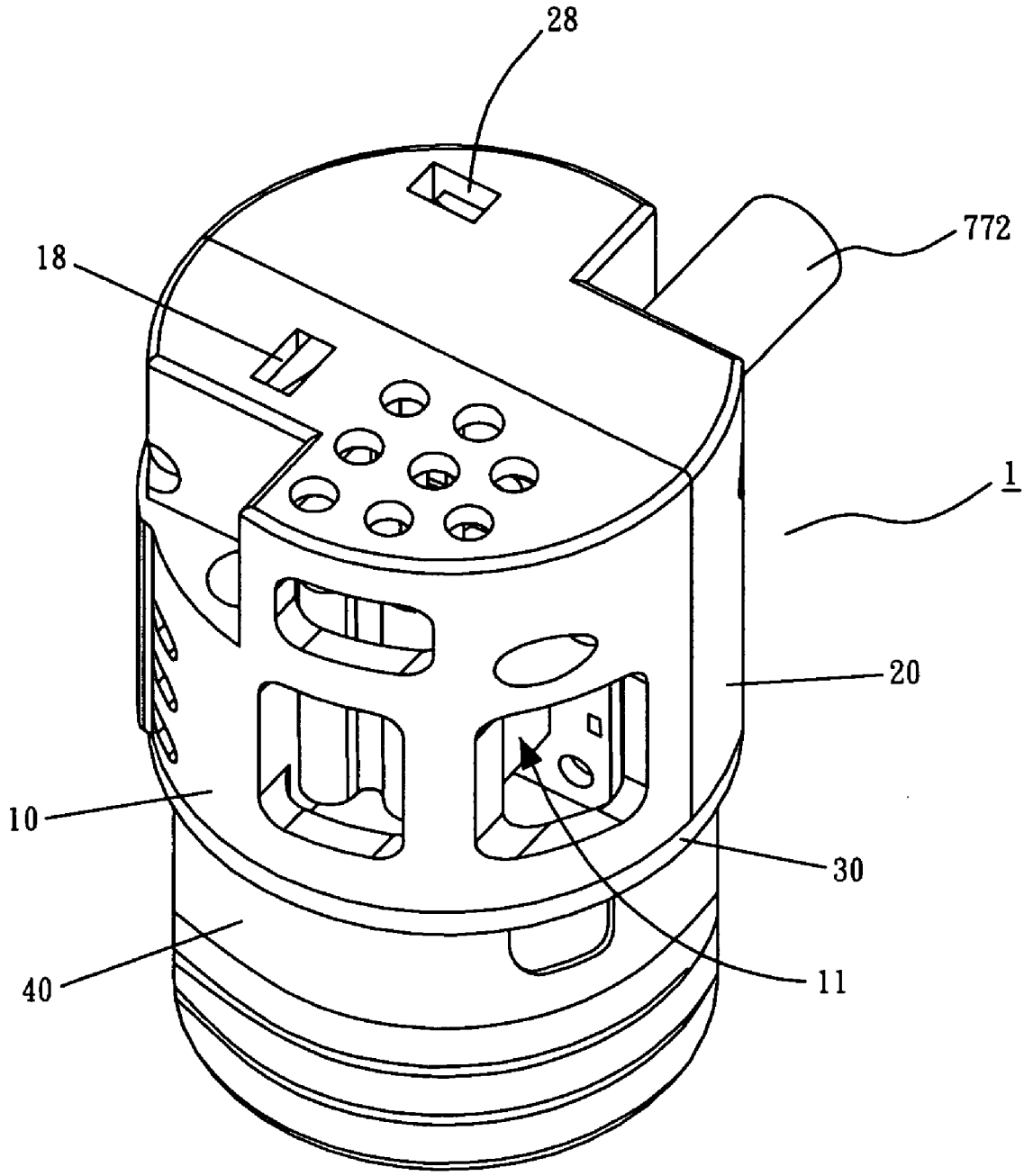
FIG. 1 is a perspective view of a lamp socket in accordance with the preferred embodiment of the present invention.
Figure 2:
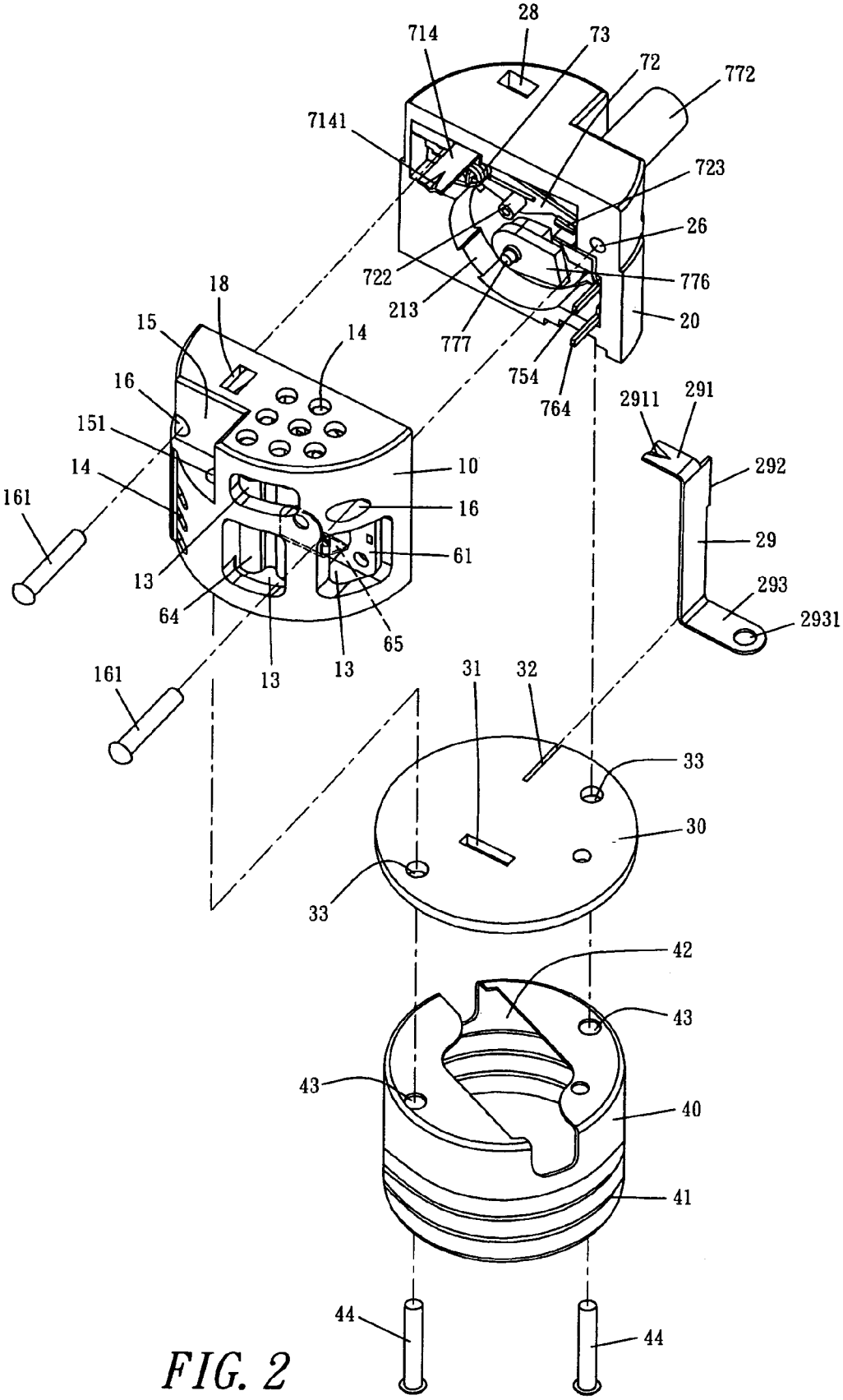
FIG. 2 is a partially exploded perspective view of the lamp socket as shown in FIG. 1.
Figure 3:
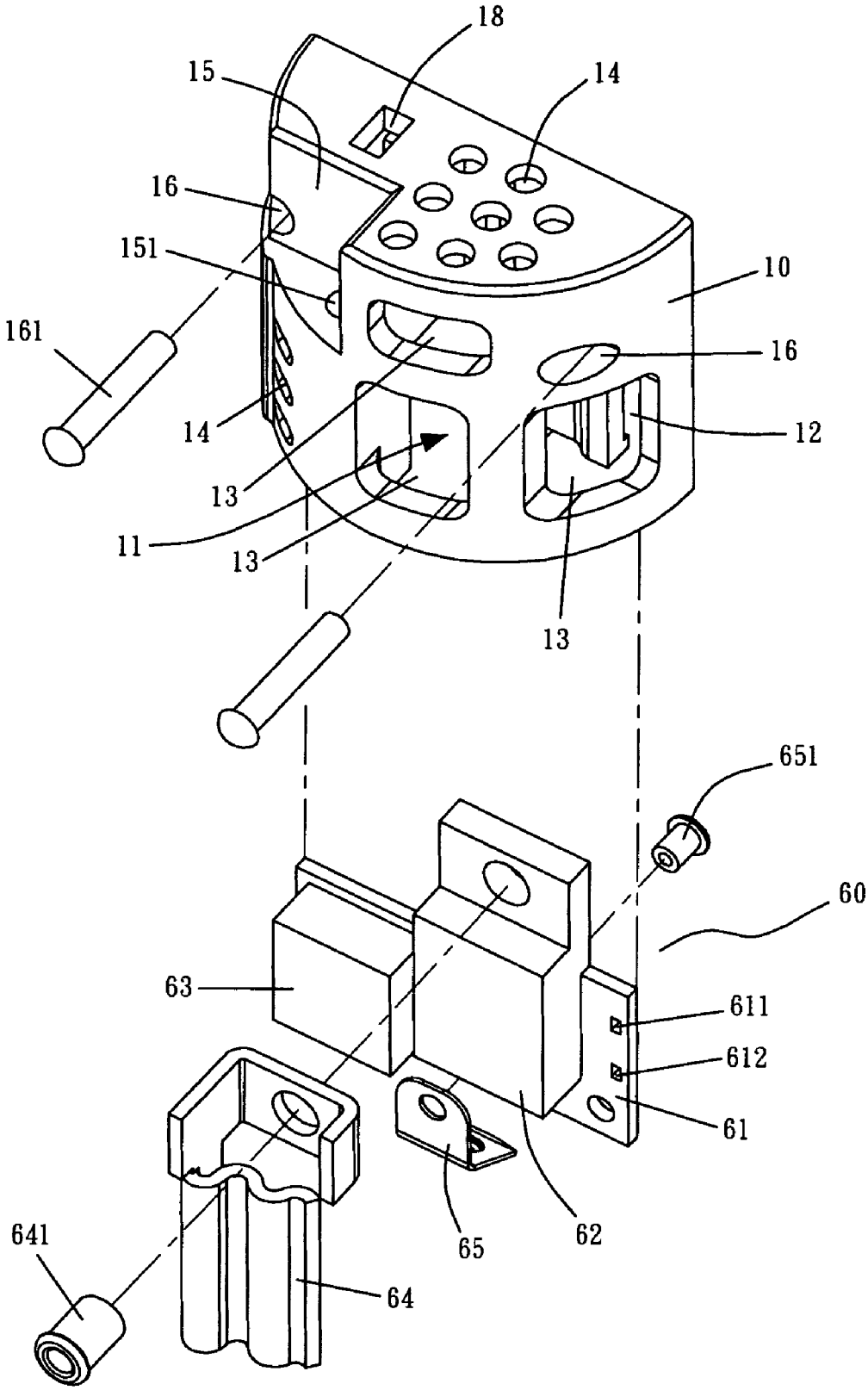
FIG. 3 is a partially exploded perspective view of the lamp socket as shown in FIG. 1.
Figure 4:
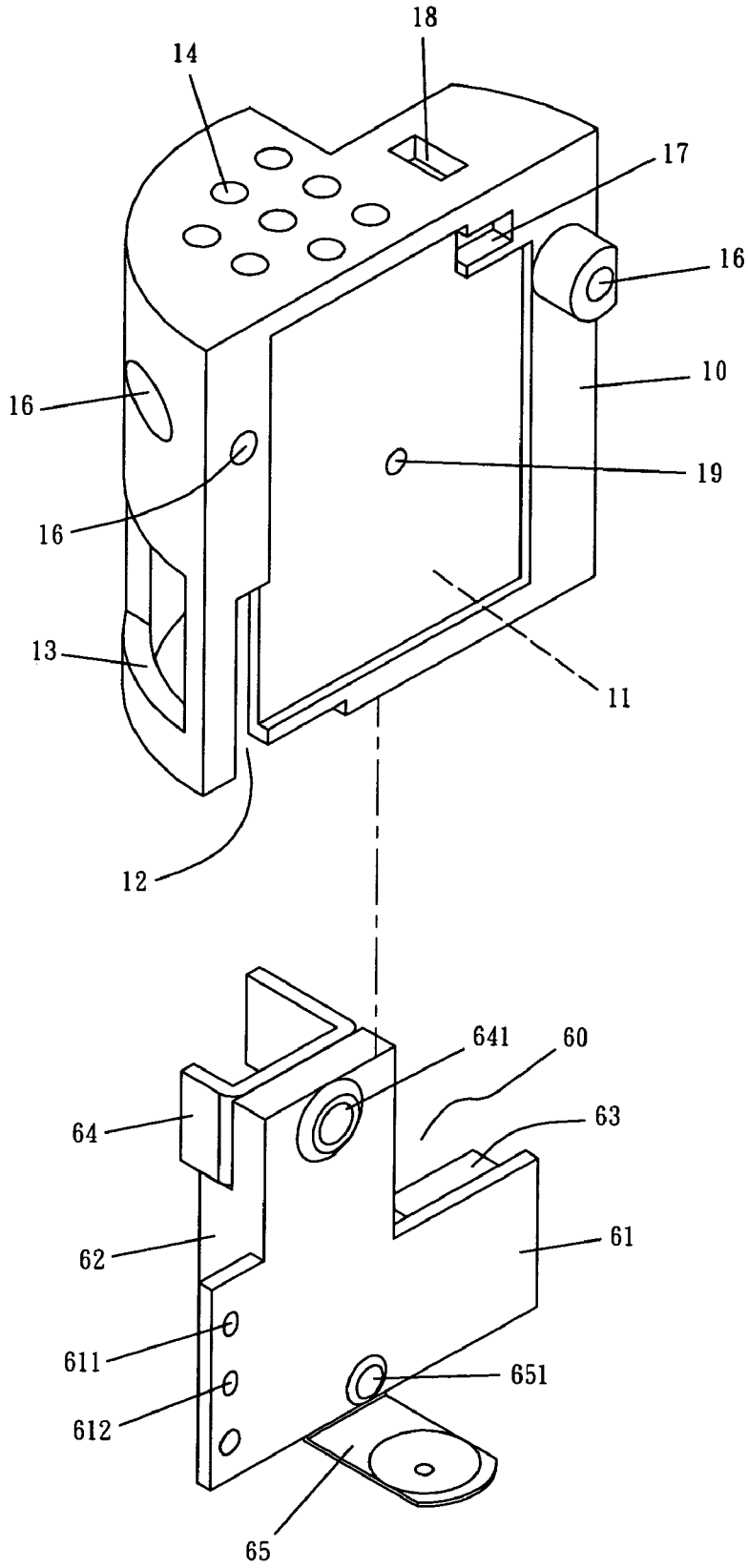
FIG. 4 is a partially exploded perspective view of the lamp socket as shown in FIG. 1.

Referring to the drawings and initially to FIGS. 1-11, a lamp socket 1 in accordance with the preferred embodiment of the present invention comprises a first shell 10, a second shell 20 combined with the first shell 10, a separation plate 30 rested on a bottom of the first shell 10 and the second shell 20, a base 40 secured to the separation plate 30, an electronic unit 60 mounted in the first shell 10 and electrically connected to the base 40 to supply an electric current to the base 40, and a light-regulating unit 70 mounted in the second shell 20 and electrically connected to the electronic unit 60 to regulate the electric current from the electronic unit 60 to the base 40.

The first shell 10 has an inside formed with a receiving chamber 11 having an open bottom to receive the electronic unit 60. The first shell 10 has a peripheral wall formed with a plurality of heat dissipation holes 13 and 14. The first shell 10 has a top face formed with a slot 18 and has a first side formed with a passage 17 connected to the slot 18. The first side of the first shell 10 has a central portion formed with a positioning hole 19 and has a bottom formed with an opening 12. The first shell 10 has a second side formed with a cutout 15 having an inside formed with a fixing bore 151 extended to the bottom of the first shell 10. The first shell 10 has a rim formed with two fixing holes 16.

Figure 5:
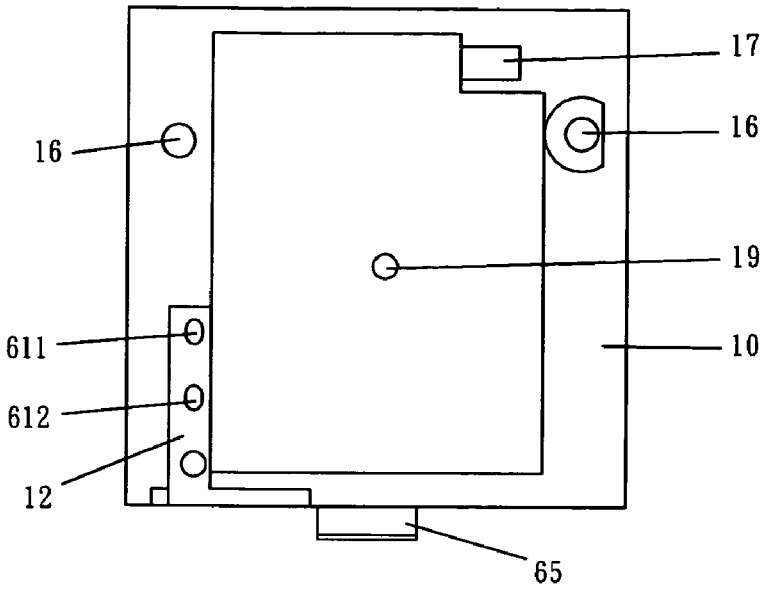
FIG. 5 is a rear plan assembly view of the lamp socket as shown in FIG. 4.
Figure 7:
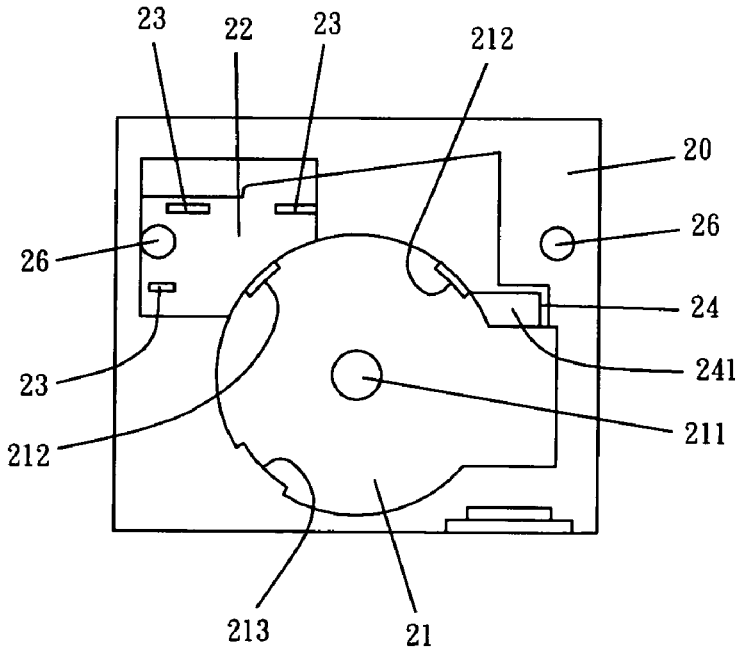
FIG. 7 is a front plan view of a second shell of the lamp socket as shown in FIG. 6.
Figure 6:
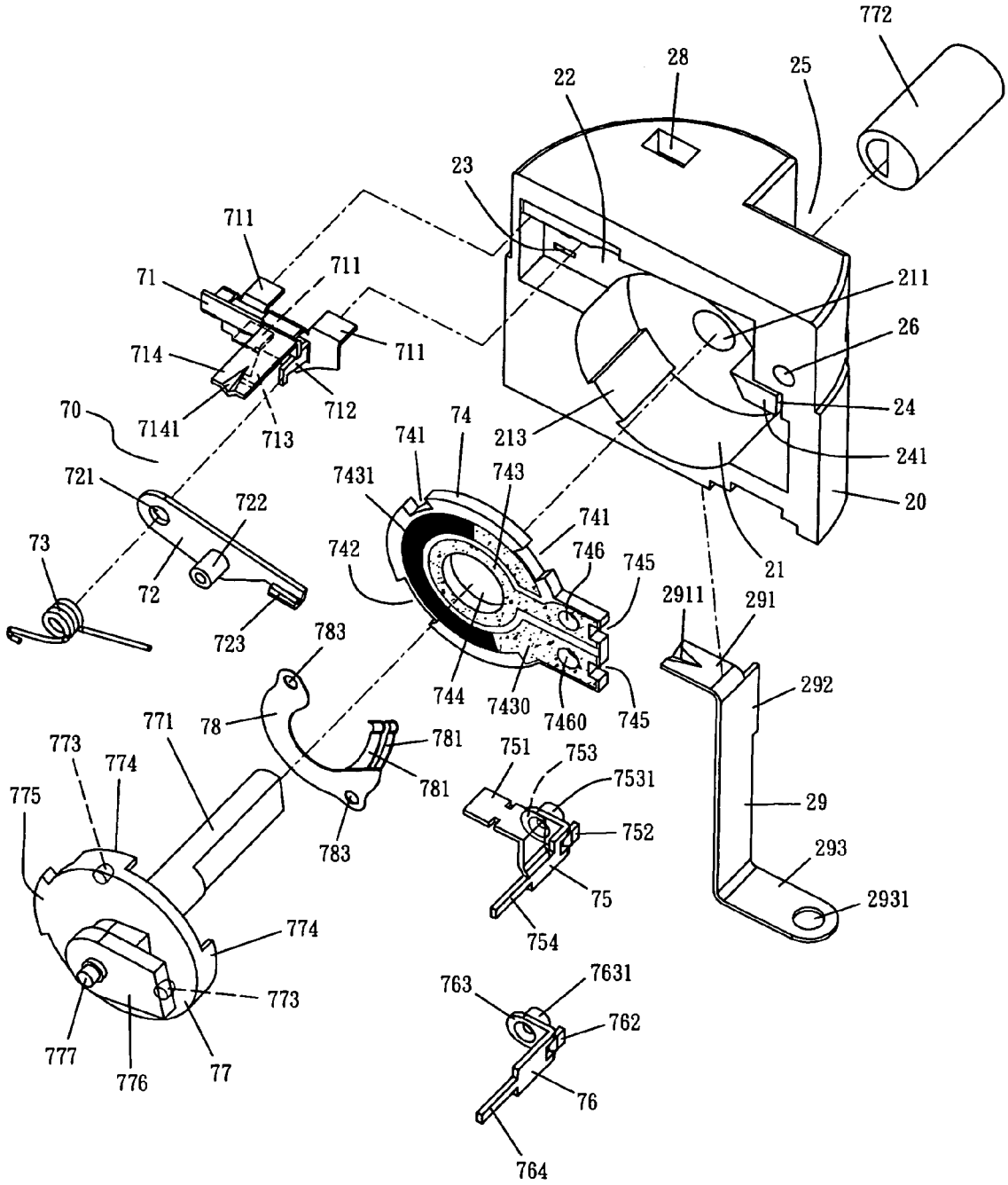
FIG. 6 is a partially exploded perspective view of the lamp socket as shown in FIG. 1.
Figure 8:
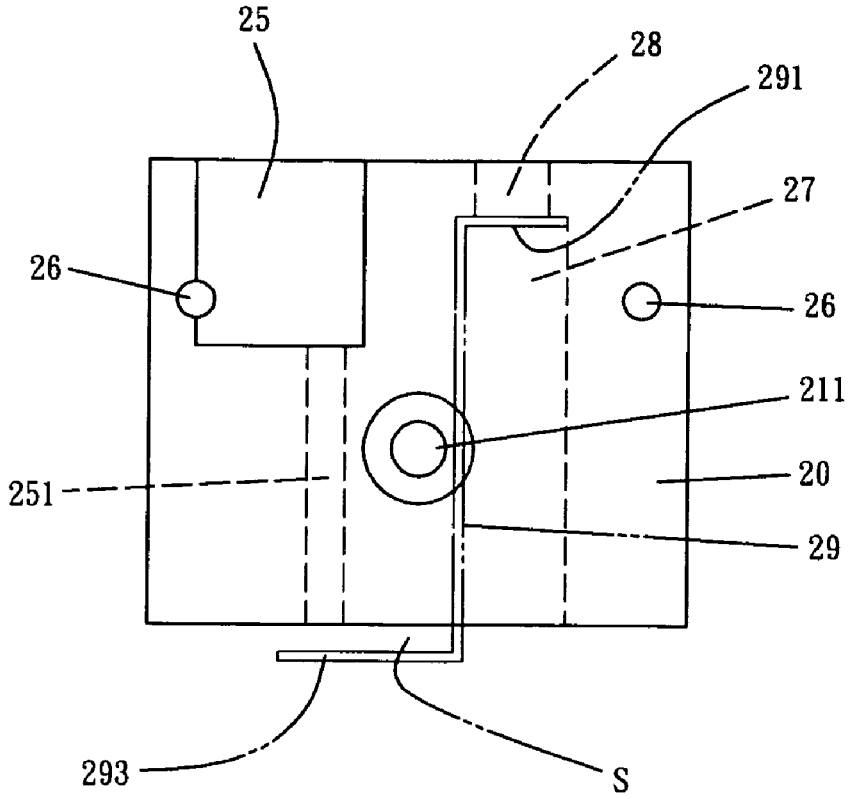
FIG. 8 is a rear plan assembly view of the lamp socket as shown in FIG. 6.
Figure 9:
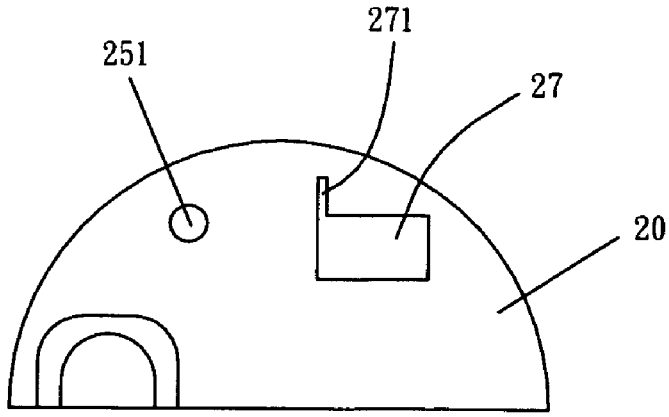
FIG. 9 is a bottom plan view of the second shell of the lamp socket as shown in FIG. 6.
Figure 11:
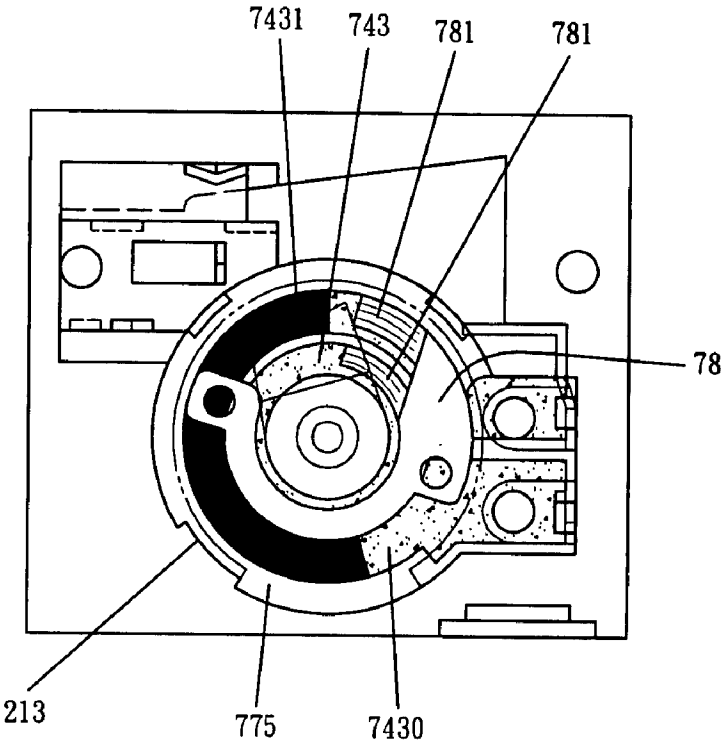
FIG. 11 is a partially cut-away front plan assembly view of the lamp socket as shown in FIG. 6.

The electronic unit 60 includes a circuit board 61 mounted in the receiving chamber 11 of the first shell 10 and having a side formed with a first hole 611 and a second hole 612 exposed from the opening 12 of the first shell 10 as shown in FIG. 5, a plurality of electronic parts mounted on the circuit board 61, a conducting plate 65 secured to the circuit board 61 by a fixing member 651 and electrically connected to the electronic parts, and a radiating plate 64 secured to the circuit board 61 by a fixing member 641 and located adjacent to the electronic parts. The conducting plate 65 of the electronic unit 60 is partially protruded outwardly from the bottom of the first shell 10 as shown in FIG. 5. The radiating plate 64 of the electronic unit 60 has a corrugated shape to increase the radiating area and has an inclined angle to allow insertion of the radiating plate 64 into the receiving chamber 11 of the first shell 10. The electronic parts of the electronic unit 60 include a triac 62, a capacitor 63, a heat sensitive resistor 66 (see FIG. 16) such as a PTC, a diac 67 (see FIG. 16), and a resistor 68 (see FIG. 16).

The second shell 20 has a first side formed with a first receiving recess 21 and a second receiving recess 22 connected to the first receiving recess 21 and a second side formed with a through hole 211 connected to the first receiving recess 21. The first receiving recess 21 of the second shell 20 has a peripheral wall formed with two first positioning blocks 212 and a second positioning block 213 having a height greater than that of each of the first positioning blocks 212. The second receiving recess 22 of the second shell 20 has a wall formed with a plurality of positioning grooves 23 and has a side provided with a protruding block 241 which is formed with a substantially L-shaped clamping slot 24. The second shell 20 has a top face formed with a slot 28 and has an inside formed with a receiving channel 27 having a first end connected to the slot 28 and a second end connected to the bottom of the second shell 20. The slot 28 of the second shell 20 has a side formed with an elongated slit 271. The second shell 20 has a second side formed with a cutout 25 having an inside formed with a fixing bore 251 extended to the bottom of the second shell 20. The second shell 20 has a rim formed with two fixing holes 26 connected to the fixing holes 16 of the first shell 10 by two connecting members 161 to combine the first shell 10 and the second shell 20.

The lamp socket 1 further comprises an electrically connecting member 29 mounted in the receiving channel 27 of the second shell 20 and having an upper end provided with an electrically connecting plate 291 having an electrically connecting terminal 2911 aligning with the slot 28 of the second shell 20 and a lower end provided with a clamping plate 293 protruding from the bottom of the second shell 20 to define a gap "S" between the clamping plate 293 and the bottom of the second shell 20. The clamping plate 293 of the electrically connecting member 29 has a through hole 2931. The electrically connecting member 29 has a side formed with a limit plate 292 limited in the elongated slit 271 of the second shell 20 to guide movement of the electrically connecting member 29.

The light-regulating unit 70 is mounted in the first receiving recess 21 and the second receiving recess 22 of the second shell 20 and includes an electrically connecting body 71, a regulating module 74, a first connecting member 75, a second connecting member 76, a pivot arm 72, a torsion spring 73, a rotation member 77, a rotation knob 772, and an electric brush 78.

The electrically connecting body 71 is mounted in the second receiving recess 22 of the second shell 20 and has a side provided with a first locking hook 712 and a second locking hook 713, and has a top provided with an electrically connecting plate 714 extended through the passage 17 of the first shell 10 and having an electrically connecting terminal 7141 aligning with the slot 18 of the first shell 10. The electrically connecting body 71 is provided with a plurality of positioning plates 711 inserted into the positioning grooves 23 of the second shell 20.

The regulating module 74 is mounted in the first receiving recess 21 of the second shell 20 and has a periphery formed with two first positioning grooves 741 to position the first positioning blocks 212 of the second shell 20 and a second positioning groove 742 to position the second positioning block 213 of the second shell 20 so that the regulating module 74 is not rotatable relative to the second shell 20. The regulating module 74 has a face provided with an inner conducting ring 743 and an outer conducting ring 7430. The outer conducting ring 7430 of the regulating module 74 is provided with a carbon resistor 7431. The regulating module 74 has a central portion formed with a through hole 744 aligning with the through hole 211 of the second shell 20 and has a side formed with two locking grooves 745.

The first connecting member 75 is mounted in the first receiving recess 21 of the second shell 20 and has a first side formed with a conducting end 754 extended through the opening 12 of the first shell 10 and the first hole 611 of the circuit board 61 and electrically connected to the circuit board 61 and a second side formed with a conducting plate 753 electrically connected to the inner conducting ring 743 of the regulating module 74 and an insert 752 inserted into one of the locking grooves 745 of the regulating module 74. The conducting plate 753 of the first connecting member 75 is formed with a lug 7531 inserted into a through hole 746 of the inner conducting ring 743. The first connecting member 75 has a face formed with a substantially L-shaped contact arm 751 mounted in and partially protruded from the clamping slot 24 of the second shell 20.

The second connecting member 76 is mounted in the first receiving recess 21 of the second shell 20 and has a first side formed with a conducting end 764 extended through the opening 12 of the first shell 10 and the second hole 612 of the circuit board 61 and electrically connected to the circuit board 61 and a second side formed with a conducting plate 763 electrically connected to the outer conducting ring 7430 of the regulating module 74 and an insert 762 inserted into the other one of the locking grooves 745 of the regulating module 74. The conducting plate 763 of the second connecting member 76 is formed with a lug 7631 inserted into a through hole 7460 of the outer conducting ring 7430.

The pivot arm 72 has a first end formed with a pivot hole 721 pivotally mounted on the first locking hook 712 of the electrically connecting body 71, a mediate portion provided with a resting rod 722 and a second end provided with a contact end 723 that is movable to contact the contact arm 751 of the first connecting member 75 to electrically connect the electrically connecting body 71 with the first connecting member 75.

The torsion spring 73 is mounted on the first locking hook 712 of the electrically connecting body 71 and has a first end locked on the second locking hook 713 of the electrically connecting body 71 and rested on the resting rod 722 of the pivot arm 72 to pivot the pivot arm 72 downward about the first locking hook 712 of the electrically connecting body 71 to move the contact end 723 of the pivot arm 72 toward the contact arm 751 of the first connecting member 75.

The rotation member 77 is rotatably mounted in the first receiving recess 21 of the second shell 20 and has a first side provided with a rotation shaft 771 extended through the through hole 744 of the regulating module 74 and the through hole 211 of the second shell 20 and a second side provided with a push plate 776 rested on a bottom of the pivot arm 72 to pivot the pivot arm 72 upward about the first locking hook 712 of the electrically connecting body 71 to detach the contact end 723 of the pivot arm 72 from the contact arm 751 of the first connecting member 75. The first side of the rotation member 77 is provided with two positioning bosses 773. The rotation member 77 has a periphery provided with a plurality of protruding blocks 774 directed toward a wall of the first receiving recess 21 of the second shell 20 and a radially outwardly extending limit block 775 that is movable to abut the second positioning block 213 of the second shell 20. The push plate 776 has a side provided with a positioning stub 777 secured in the positioning hole 19 of the first shell 10.

The rotation knob 772 is rotatably mounted in the cutout 25 of the second shell 20 and secured to a distal end of the rotation shaft 771 to rotate the rotation member 77.

The electric brush 78 is secured on the rotation member 77 to rotate therewith and has two tail ends 781 electrically connected to the inner conducting ring 743 and the outer conducting ring 7430 of the regulating module 74 respectively. One of the tail ends 781 of the electric brush 78 is movable on the carbon resistor 7431 of the outer conducting ring 7430 to change the resistance. The electric brush 78 has two positioning holes 783 mounted on the positioning bosses 773 of the rotation member 77.

The separation plate 30 is received in the gap "S" between the clamping plate 293 and the bottom of the second shell 20 and clamped by the clamping plate 293. The separation plate 30 has a periphery formed with a clamping slit 32 clamped on the electrically connecting member 29. The separation plate 30 has a passage 31 to allow passage of the conducting plate 65 of the electronic unit 60 and has two fixing bores 33 connected to the fixing bore 151 of the first shell 10 and the fixing bore 251 of the second shell 20 respectively by two connecting members 44 to combine the separation plate 30 with the first shell 10 and the second shell 20. The through hole 2931 of the clamping plate 293 of the electrically connecting member 29 aligns with one of the fixing bores 33 of the separation plate 30 to allow passage of one of the connecting members 44.

The base 40 is secured to a bottom face of the separation plate 30 and electrically connected to the clamping plate 293 of the electrically connecting member 29. The base 40 has a top formed with an opening 42 to allow passage of the conducting plate 65 of the electronic unit 60 and a peripheral wall formed with a threaded portion 41 screwed onto the screw portion (not shown) of an electric bulb (not shown) when the electric bulb is screwed into the base 40. The electric bulb has a head portion (not shown) electrically connected to the conducting plate 65 of the electronic unit 60. The base 40 has two fixing bores 43 to allow passage of the connecting members 44.

In operation, referring to FIGS. 1-16, the connecting terminal 7141 of the electrically connecting plate 714 of the electrically connecting body 71 and the electrically connecting terminal 2911 of the electrically connecting plate 291 of the electrically connecting member 29 are electrically connected to two electric wires (not shown) of a power supply (not shown) respectively. In such a manner, the electrically connecting member 29 is electrically conducted by the respective electric wire to conduct the base 40. Thus, when the electric bulb is screwed into the base 40, the screw portion of the electric bulb is electrically conducted by the base 40.

On the other hand, the electrically connecting body 71 is electrically conducted by the respective electric wire to conduct the pivot arm 72.

Figure 10:
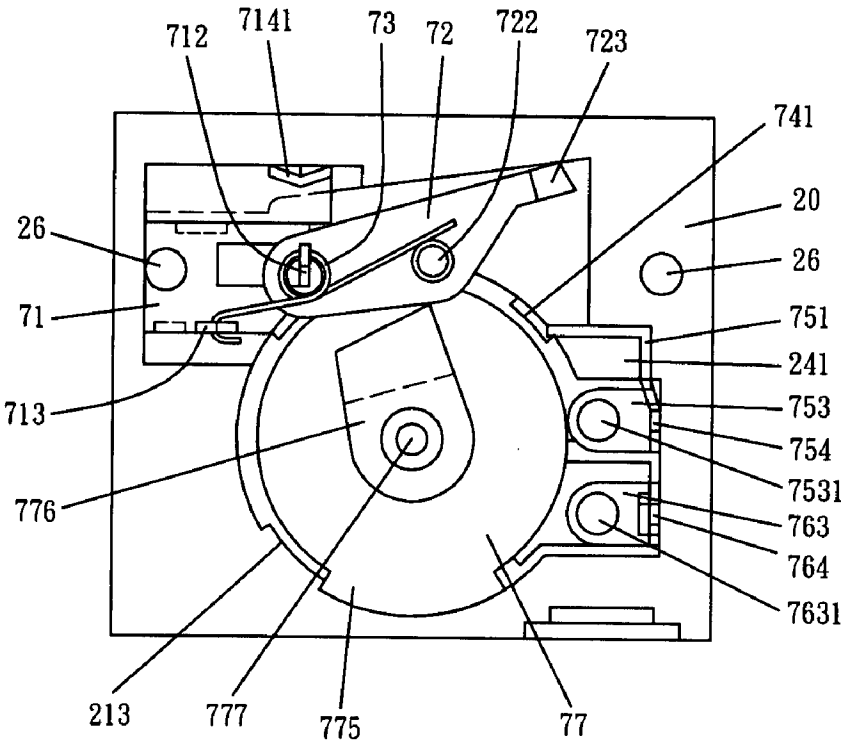
FIG. 10 is a front plan assembly view of the lamp socket as shown in FIG. 6.

When the push plate 776 is rotated with the rotation member 77 (which is rotated by the rotation knob 772) to rest on the bottom of the pivot arm 72 as shown in FIG. 10, the pivot arm 72 is pivoted upward about the first locking hook 712 of the electrically connecting body 71 to detach the contact end 723 of the pivot arm 72 from the contact arm 751 of the first connecting member 75, so that the first connecting member 75 is not electrically connected to the pivot arm 72. Thus, the lamp socket 1 is turned off so that the electric bulb is not lighted. At this time, the limit block 775 of the rotation member 77 is movable to abut the right side of the second positioning block 213 of the second shell 20 as shown in FIG. 10 to limit rotation of the rotation member 77.

Figure 12:
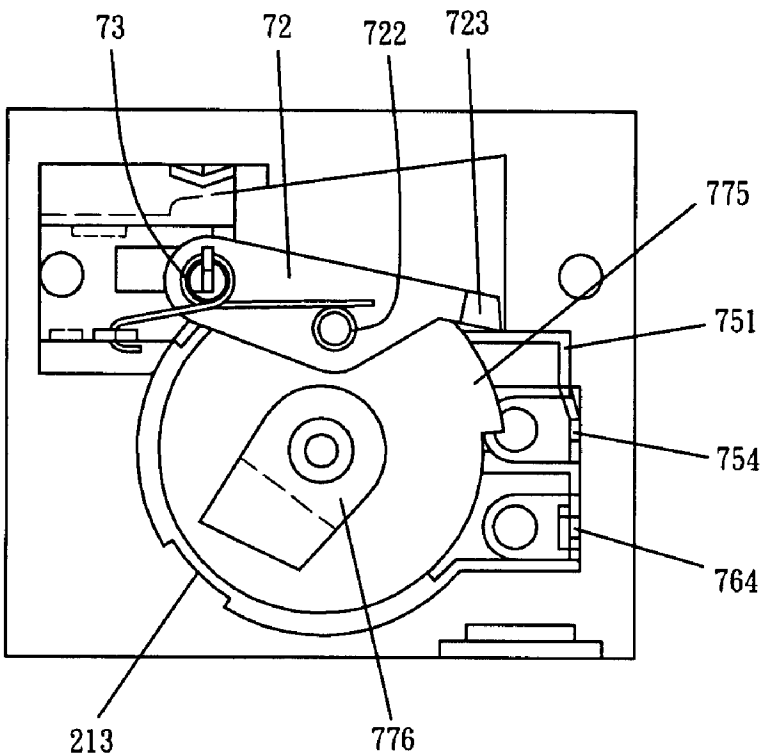
FIG. 12 is a schematic operational view of the lamp socket as shown in FIG. 10.
Figure 16:
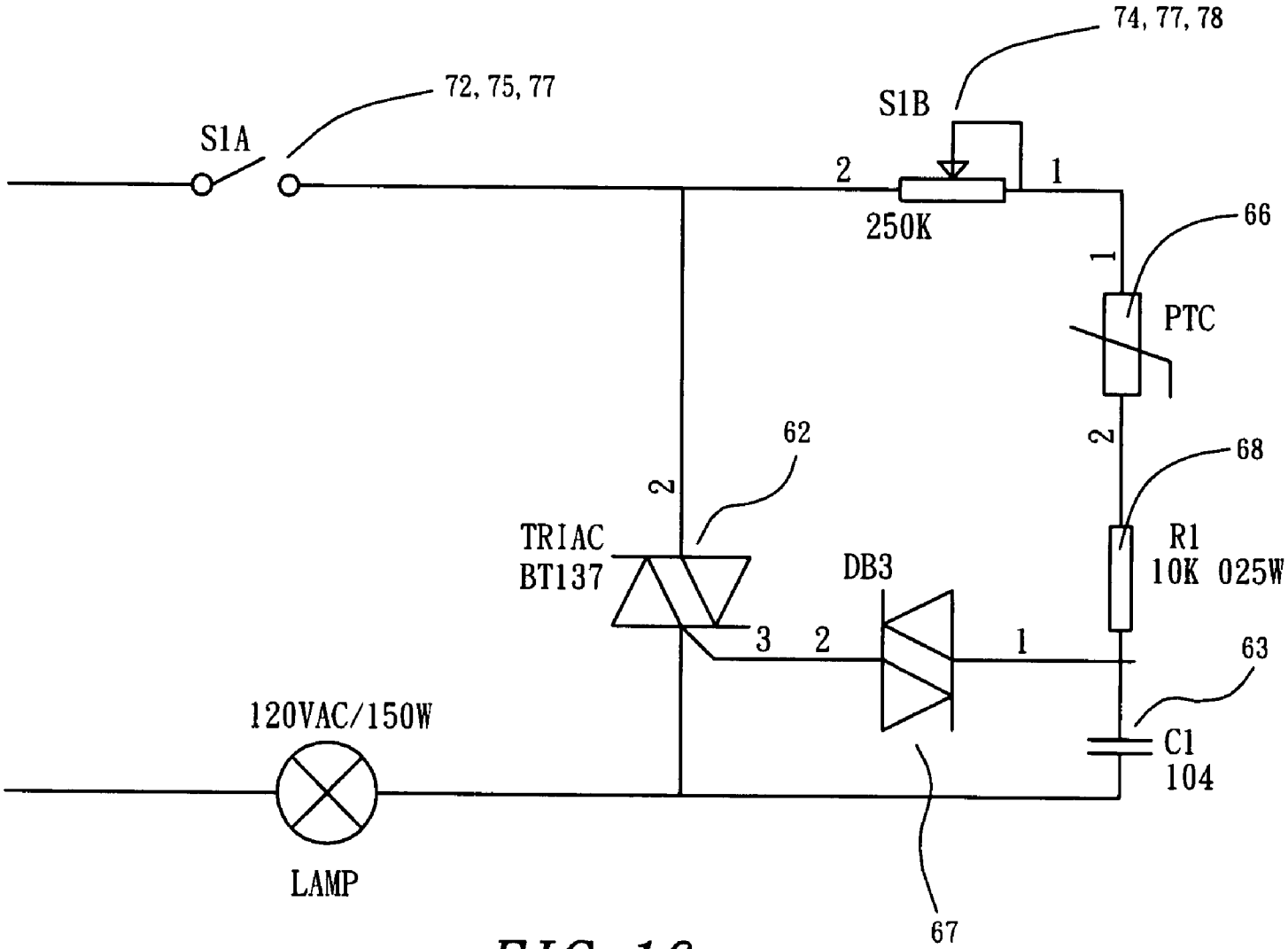
FIG. 16 is a circuit layout of the lamp socket as shown in FIG. 1.

Alternatively, when the push plate 776 is rotated with the rotation member 77 (which is rotated by the rotation knob 772) to detach from the bottom of the pivot arm 72 as shown in FIG. 12, the pivot arm 72 is pivoted downward about the first locking hook 712 of the electrically connecting body 71 by the restoring force of the torsion spring 73 to move the contact end 723 of the pivot arm 72 toward the contact arm 751 of the first connecting member 75 to contact the contact arm 751 of the first connecting member 75, so that the first connecting member 75 is electrically connected to the electrically connecting body 71 via the pivot arm 72. Then, the electric current from the first connecting member 75 in turn passes through the inner conducting ring 743 of the regulating module 74, the tail ends 781 of the electric brush 78 and the outer conducting ring 7430 of the regulating module 74 into the second connecting member 76, so that the second connecting member 76 is electrically conducted by the first connecting member 75. Then, the electric current from the second connecting member 76 passes through the circuit board 61 into the conducting plate 65, so that the head portion of the electric bulb is electrically conducted by the conducting plate 65. Thus, the screw portion of the electric bulb is electrically conducted by the base 40, and the head portion of the electric bulb is electrically conducted by the conducting plate 65, thereby forming a whole circuit as shown in FIG. 16, so that the lamp socket 1 is turned on and the electric bulb is lighted.

Figure 13:
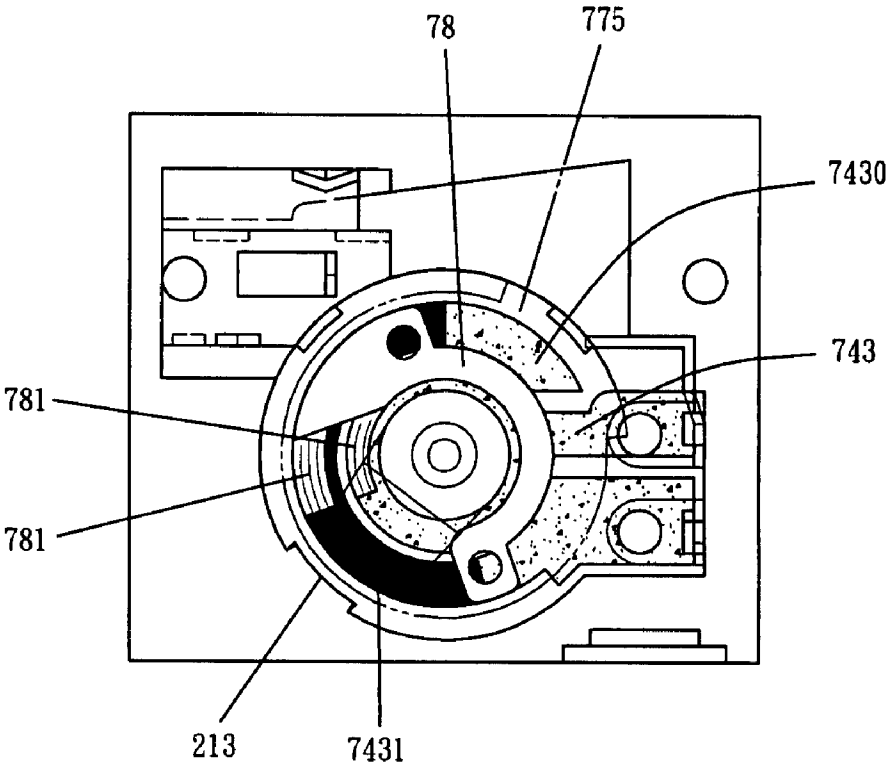
FIG. 13 is a schematic operational view of the lamp socket as shown in FIG. 11.

As shown in FIG. 13, one of the tail ends 781 of the electric brush 78 is movable on the carbon resistor 7431 of the outer conducting ring 7430 to change the resistance, so that the current is affected by the carbon resistor 7431. At the same time, the resistance is decreased gradually and the current is increased gradually during movement of one of the tail ends 781 of the electric brush 78 so as to regulate the lightness of the electric bulb.

Figure 14:
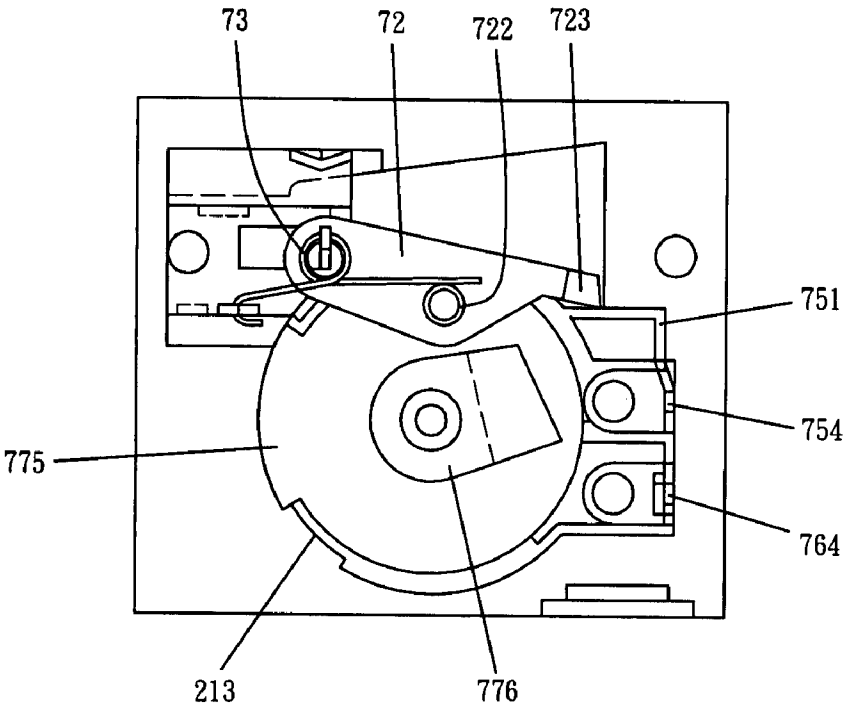
FIG. 14 is a schematic operational view of the lamp socket as shown in FIG. 12.

As shown in FIG. 14, the limit block 775 of the rotation member 77 is movable to abut the left side of the second positioning block 213 of the second shell 20 to limit rotation of the rotation member 77.

Figure 15:
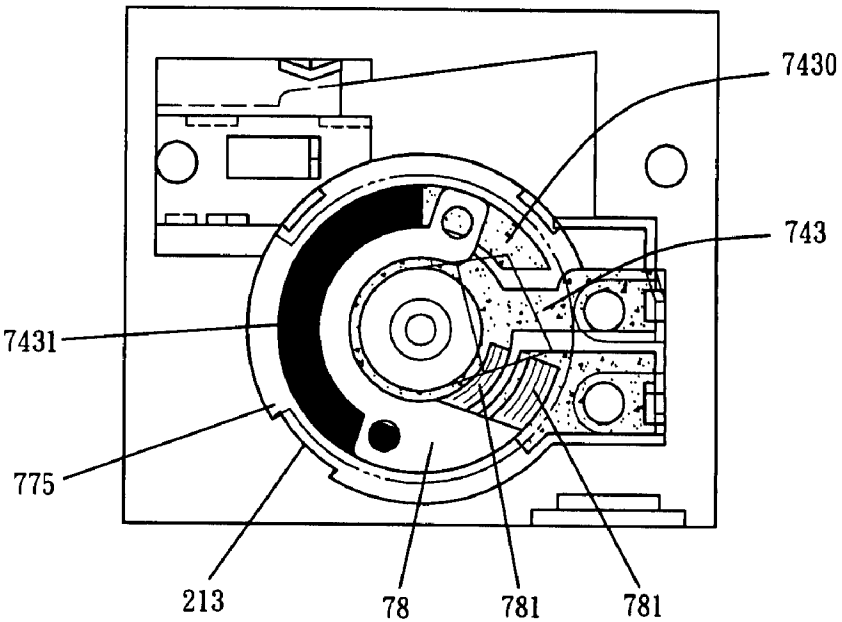
FIG. 15 is a schematic operational view of the lamp socket as shown in FIG. 13.

At the same time, one of the tail ends 781 of the electric brush 78 is detached from the carbon resistor 7431 of the outer conducting ring 7430 as shown in FIG. 15, so that the current is not affected by the carbon resistor 7431 and reaches the maximum value.

Accordingly, the electronic unit 60 is used to provide a current to light the electric bulb, and the light-regulating unit 70 is used to regulate the current value of the electric bulb, so that the lamp socket has a light-regulating function. In addition, the current value of the electric bulb is regulated successively by rotation of the rotation member 77, so that the lamp socket has a stageless light-regulating function. Further, the heat dissipation holes 13 and 14 and the radiating plate 64 are used to provide a heat radiating effect to the electronic parts of the electronic unit 60, so that the electronic parts are operated smoothly and stably. Further, the heat sensitive resistor 66 of the electronic unit 60 has a resistance (about 100K to 200K) that is increased with rise of the temperature to reduce the lightness and temperature of the electric bulb and is decreased with drop of the temperature to increase the lightness and temperature of the electric bulb so as to control the temperature and to regulate the lightness of the electric bulb automatically.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lamp socket, comprising:

a first shell;

a second shell combined with the first shell;

a separation plate rested on a bottom of the first shell and the second shell;

a base secured to the separation plate;

an electronic unit mounted in the first shell and electrically connected to the base to supply an electric current to the base;

a light-regulating unit mounted in the second shell and electrically connected to the electronic unit to regulate the electric current from the electronic unit to the base; wherein:

the first shell has an inside formed with a receiving chamber having an open bottom to receive the electronic unit, a top face formed with a slot, and a first side formed with a passage connected to the slot, the first side of the first shell has a bottom formed with an opening;

the electronic unit includes a circuit board mounted in the receiving chamber of the first shell and having a side formed with a first hole and a second hole exposed from the opening of the first shell, a plurality of electronic parts mounted on the circuit board, and a conducting plate secured to the circuit board and electrically connected to the electronic parts;

the second shell has a first side formed with a first receiving recess and a second receiving recess connected to the first receiving recess and a second side formed with a through hole connected to the first receiving recess, the second shell has a top face formed with a slot and has an inside formed with a receiving channel having a first end connected to the slot and a second end connected to the bottom of the second shell;

the lamp socket further comprises an electrically connecting member mounted in the receiving channel of the second shell and having an upper end provided with an electrically connecting plate having an electrically connecting terminal aligning with the slot of the second shell and a lower end provided with a clamping plate;

the light-regulating unit includes an electrically connecting body, a regulating module, a first connecting member, a second connecting member, a pivot arm, a torsion spring, a rotation member, a rotation knob, and an electric brush;

the electrically connecting body has a side provided with a first locking hook and a second locking hook, and has a top provided with an electrically connecting plate extended through the passage of the first shell and having an electrically connecting terminal aligning with the slot of the first shell;

the regulating module has a face provided with an inner conducting ring and an outer conducting ring, the outer conducting ring of the regulating module is provided with a carbon resistor;

the first connecting member has a face formed with a contact arm and has a first side formed with a conducting end extended through the opening of the first shell and the first hole of the circuit board and electrically connected to the circuit board and a second side formed with a conducting plate electrically connected to the inner conducting ring of the regulating module;

the second connecting member has a first side formed with a conducting end extended through the opening of the first shell and the second hole of the circuit board and electrically connected to the circuit board and a second side formed with a conducting plate electrically connected to the outer conducting ring of the regulating module;

the pivot arm has a first end formed with a pivot hole pivotally mounted on the first locking hook of the electrically connecting body, a mediate portion provided with a resting rod and a second end provided with a contact end that is movable to contact the contact arm of the first connecting member to electrically connect the electrically connecting body with the first connecting member;

the torsion spring is mounted on the first locking hook of the electrically connecting body and has a first end locked on the second locking hook of the electrically connecting body and rested on the resting rod of the pivot arm to pivot the pivot arm downward about the first locking hook of the electrically connecting body to move the contact end of the pivot arm toward the contact arm of the first connecting member;

the rotation member has a first side provided with a rotation shaft extended through the through hole of the second shell and a second side provided with a push plate rested on a bottom of the pivot arm to pivot the pivot arm upward about the first locking hook of the electrically connecting body to detach the contact end of the pivot arm from the contact arm of the first connecting member;

the rotation knob is secured to a distal end of the rotation shaft to rotate the rotation member;

the electric brush is secured on the rotation member to rotate therewith and has two tail ends electrically connected to the inner conducting ring and the outer conducting ring of the regulating module respectively.

2. The lamp socket in accordance with claim 1, wherein the first shell has a peripheral wall formed with a plurality of heat dissipation holes.

3. The lamp socket in accordance with claim 1, wherein the conducting plate of the electronic unit is partially protruded outwardly from the bottom of the first shell.

4. The lamp socket in accordance with claim 1, wherein the electronic unit further includes a radiating plate secured to the circuit board by a fixing member and located adjacent to the electronic parts.

5. The lamp socket in accordance with claim 1, wherein the electronic parts of the electronic unit include a triac, a capacitor, a heat sensitive resistor, a diac, and a resistor.

6. The lamp socket in accordance with claim 1, wherein:

the clamping plate of the electrically connecting member is protruding from the bottom of the second shell to define a gap between the clamping plate and the bottom of the second shell;

the separation plate is received in the gap between the clamping plate and the bottom of the second shell and clamped by the clamping plate, the separation plate has a periphery formed with a clamping slit clamped on the electrically connecting member, the separation plate has a passage to allow passage of the conducting plate of the electronic unit;

the base is secured to a bottom face of the separation plate and electrically connected to the clamping plate of the electrically connecting member, the base has a top formed with an opening to allow passage of the conducting plate of the electronic unit and a peripheral wall formed with a threaded portion.

7. The lamp socket in accordance with claim 1, wherein the first side of the first shell has a central portion formed with a positioning hole, and the push plate has a side provided with a positioning stub secured in the positioning hole of the first shell.

8. The lamp socket in accordance with claim 1, wherein:

the first receiving recess of the second shell has a peripheral wall formed with two first positioning blocks and a second positioning block;

the rotation member has a periphery provided with a plurality of protruding blocks directed toward a wall of the first receiving recess of the second shell and a radially outwardly extending limit block that is movable to abut the second positioning block of the second shell;

the regulating module has a periphery formed with two first positioning grooves to position the first positioning blocks of the second shell and a second positioning groove to position the second positioning block of the second shell so that the regulating module is not rotatable relative to the second shell.

9. The lamp socket in accordance with claim 1, wherein the second receiving recess of the second shell has a wall formed with a plurality of positioning grooves, and the electrically connecting body is provided with a plurality of positioning plates inserted into the positioning grooves of the second shell.

10. The lamp socket in accordance with claim 1, wherein the second receiving recess of the second shell has a side provided with a protruding block which is formed with a substantially L-shaped clamping slot, and the contact arm of the first connecting member is substantially L-shaped and is mounted in and partially protruded from the clamping slot of the second shell.

11. The lamp socket in accordance with claim 1, wherein the slot of the second shell has a side formed with an elongated slit, and the electrically connecting member has a side formed with a limit plate limited in the elongated slit of the second shell to guide movement of the electrically connecting member.

12. The lamp socket in accordance with claim 1, wherein:

the first shell has a second side formed with a cutout having an inside formed with a fixing bore extended to the bottom of the first shell;

the second shell has a second side formed with a cutout having an inside formed with a fixing bore extended to the bottom of the second shell;

the separation plate has two fixing bores connected to the fixing bore of the first shell and the fixing bore of the second shell respectively by two connecting members to combine the separation plate with the first shell and the second shell;

the clamping plate of the electrically connecting member has a through hole aligning with one of the fixing bores of the separation plate to allow passage of one of the connecting members;

the base has two fixing bores to allow passage of the connecting members.

13. The lamp socket in accordance with claim 1, wherein:

the regulating module has a side formed with two locking grooves;

the second side of the first connecting member is formed with an insert inserted into one of the locking grooves of the regulating module;

the second side of the second connecting member is formed with an insert inserted into the other one of the locking grooves of the regulating module.

14. The lamp socket in accordance with claim 1, wherein the conducting plate of the first connecting member is formed with a lug inserted into a through hole of the inner conducting ring, and the conducting plate of the second connecting member is formed with a lug inserted into a through hole of the outer conducting ring.

15. The lamp socket in accordance with claim 1, wherein the first side of the rotation member is provided with two positioning bosses, the electric brush has two positioning holes mounted on the positioning bosses of the rotation member, and one of the tail ends of the electric brush is movable on the carbon resistor of the outer conducting ring.

16. The lamp socket in accordance with claim 1, wherein the light-regulating unit is mounted in the first receiving recess and the second receiving recess of the second shell, the electrically connecting body is mounted in the second receiving recess of the second shell, the regulating module is mounted in the first receiving recess of the second shell, the first connecting member is mounted in the first receiving recess of the second shell, the second connecting member is mounted in the first receiving recess of the second shell, the rotation member is rotatably mounted in the first receiving recess of the second shell.

17. The lamp socket in accordance with claim 1, wherein the regulating module has a central portion formed with a through hole aligning with the through hole of the second shell to allow passage of the rotation shaft.

18. The lamp socket in accordance with claim 1, wherein the radiating plate of the electronic unit has a corrugated shape to increase a radiating area and has an inclined angle to allow insertion of the radiating plate into the receiving chamber of the first shell.

19. The lamp socket in accordance with claim 1, wherein the first shell has a rim formed with two fixing holes, and the second shell has a rim formed with two fixing holes connected to the fixing holes of the first shell by two connecting members to combine the first shell and the second shell.

* * * * *